US006746374B2

(12) United States Patent
Chang

(10) Patent No.: US 6,746,374 B2
(45) Date of Patent: Jun. 8, 2004

(54) FOLDING DEVICE FOR TREADMILLS

(76) Inventor: Dick Chang, No. 42, Lane 12, Shenlin Rd, Shen-Kang Hsiang Tai-Chung Hsien (TW)

( * ) Notice: Subject to any disclaimer, the term of this patent is extended or adjusted under 35 U.S.C. 154(b) by 236 days.

(21) Appl. No.: 10/125,375

(22) Filed: Apr. 19, 2002

(65) Prior Publication Data

US 2003/0125166 A1 Jul. 3, 2003

(30) Foreign Application Priority Data

Dec. 27, 2001 (TW) ..... 90224369 U

(51) Int. Cl.[7] ..... A63B 22/02
(52) U.S. Cl. ..... 482/54
(58) Field of Search ..... 482/51, 54, 904

(56) References Cited

U.S. PATENT DOCUMENTS 5,868,648 A * 2/1999 Coody et al. ..... 482/54
6,050,923 A * 4/2000 Yu ..... 482/54
6,419,612 B1 * 7/2002 Yu ..... 482/54
6,638,200 B2 * 10/2003 Chang ..... 482/54

* cited by examiner

*Primary Examiner*—Stephen R. Crow
(74) *Attorney, Agent, or Firm*—Rosenberg, Klein & Lee

(57) ABSTRACT

A treadmill includes a base which has two side tubes and each side tube has a slot defined in an inside thereof and an aperture is defined in an underside of each of the two side tubes. The two apertures communicate with an interior of the two side tubes. A folding device has a shaft with its two ends inserted in the two slots and two rollers are connected to the two ends of the shaft. Two side frames are connected to the shaft and two sides of an operation frame are pivotally connected to the two side frames. Two links are pivotally connected between the two side frames and the base. When folding the operation frame at an upright position, the two rollers are moved in the side tubes of the base and drop through the apertures to contact the floor so as to provide better support of the treadmill.

3 Claims, 9 Drawing Sheets

FOLDING DEVICE FOR TREADMILLS

FIELD OF THE INVENTION

The present invention relates to a treadmill that has a folding device comprising two rollers movably received in side tubes of the base and dropping through holes in the bottom of the side tubes to contact the floor when the operation frame is folded upward.

BACKGROUND OF THE INVENTION

A conventional treadmill is shown in FIGS. 7, 8A and 8B and generally includes a base 72 and an end of the operation frame 70 is pivotally connected to the base 72. A folding device 73 is connected to the base 72 and includes links 731 which are driven by a worm rod and a motor so as to lift the end of the operation frame 70 as shown to adjust the inclination of the operation frame relative to the floor. The folding device 73 has a pair of rollers 732, the front end of the base 72 has another pair of rollers 721 and the operation frame 70 has two protrusions 711. The rollers 732, 721 and the protrusions 711 support the whole treadmill. It is not convenient for the user to fold the operation frame 70 upward because the rollers 732 make the treadmill to move and this movement results in a difficulty for folding the operation frame 70.

The present invention intends to provide a folding device for a treadmill wherein the folding device has rollers received in the tubes of the base and contacting the floor when the operation frame is folded to upright position.

SUMMARY OF THE INVENTION

In accordance with one aspect of the present invention, there is provided a treadmill which comprises a base comprising two side tubes and each side tube has a slot in an inside thereof. An aperture is defined in an underside of each of the two side tubes and communicates with an interior of the side tube corresponding thereto.

A folding device comprises a shaft and two rollers are connected to two ends of the shaft. Two ends of the shaft extend in the two respective slots and the two rollers are received in the interior in the two side tubes. Two side frames are connected to the shaft and two sides of an operation frame are pivotally connected to the two side frames. Two links are pivotally connected between the two side frames and the two side tubes of the base.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
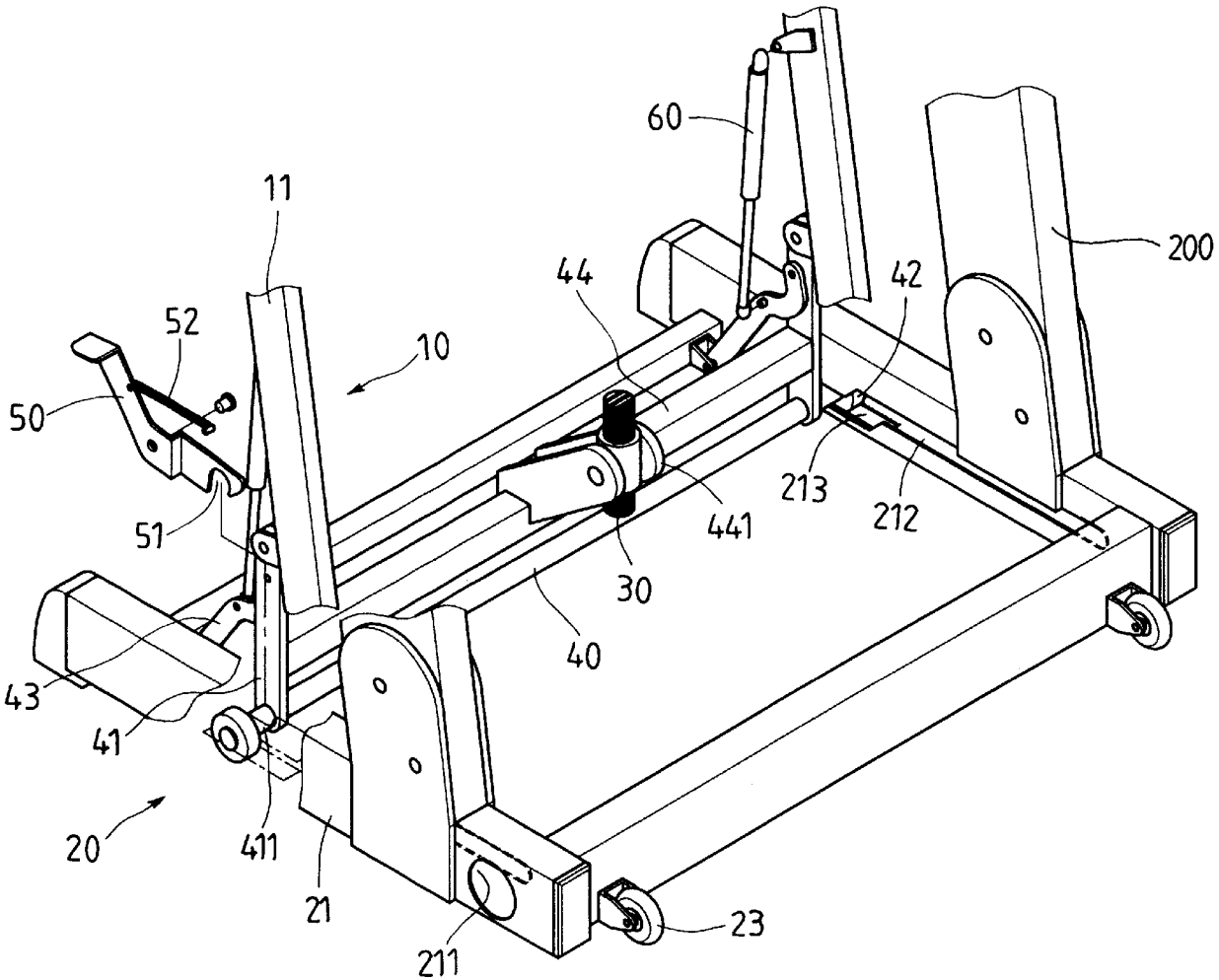
FIG. 1 shows the base and the folding device of the treadmill of the present invention wherein the rollers of the folding device drop in the apertures in the side tubes of the base.
Figure 2:
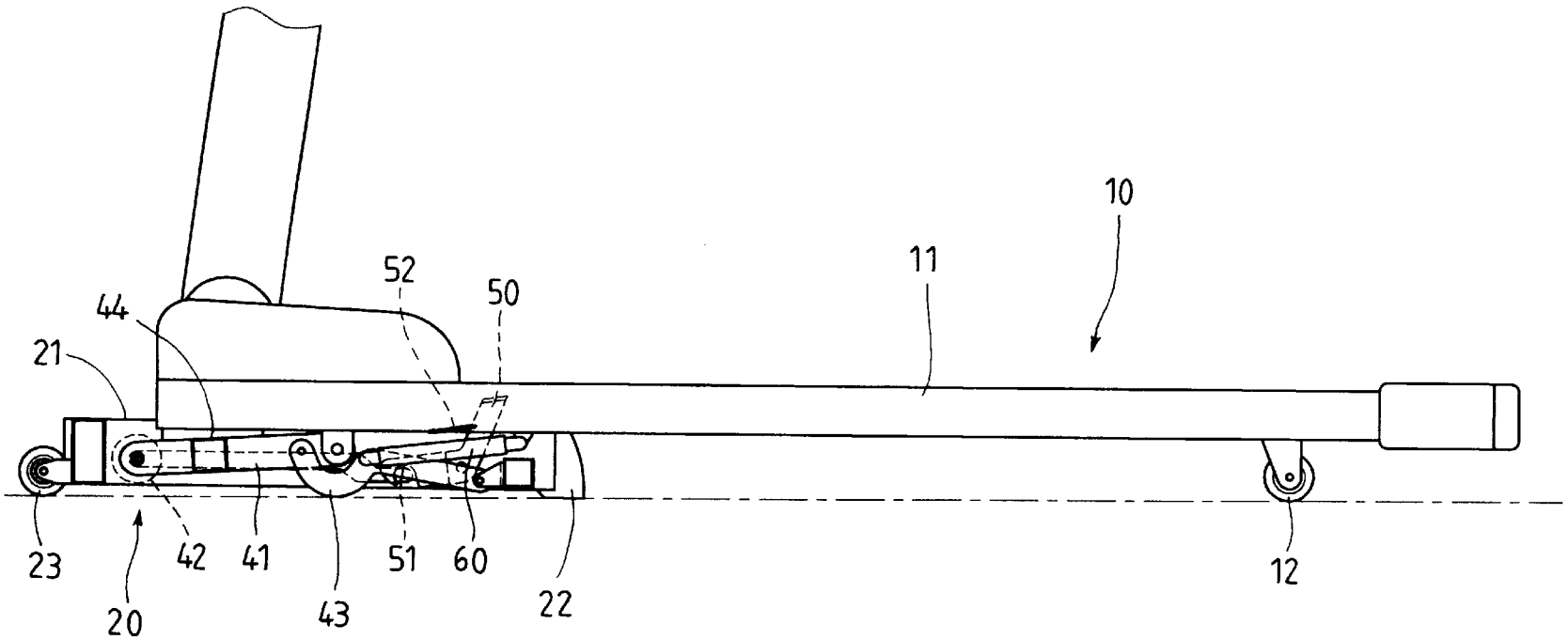
FIG. 2 is a side view to show the treadmill of the present invention.
Figure 3:
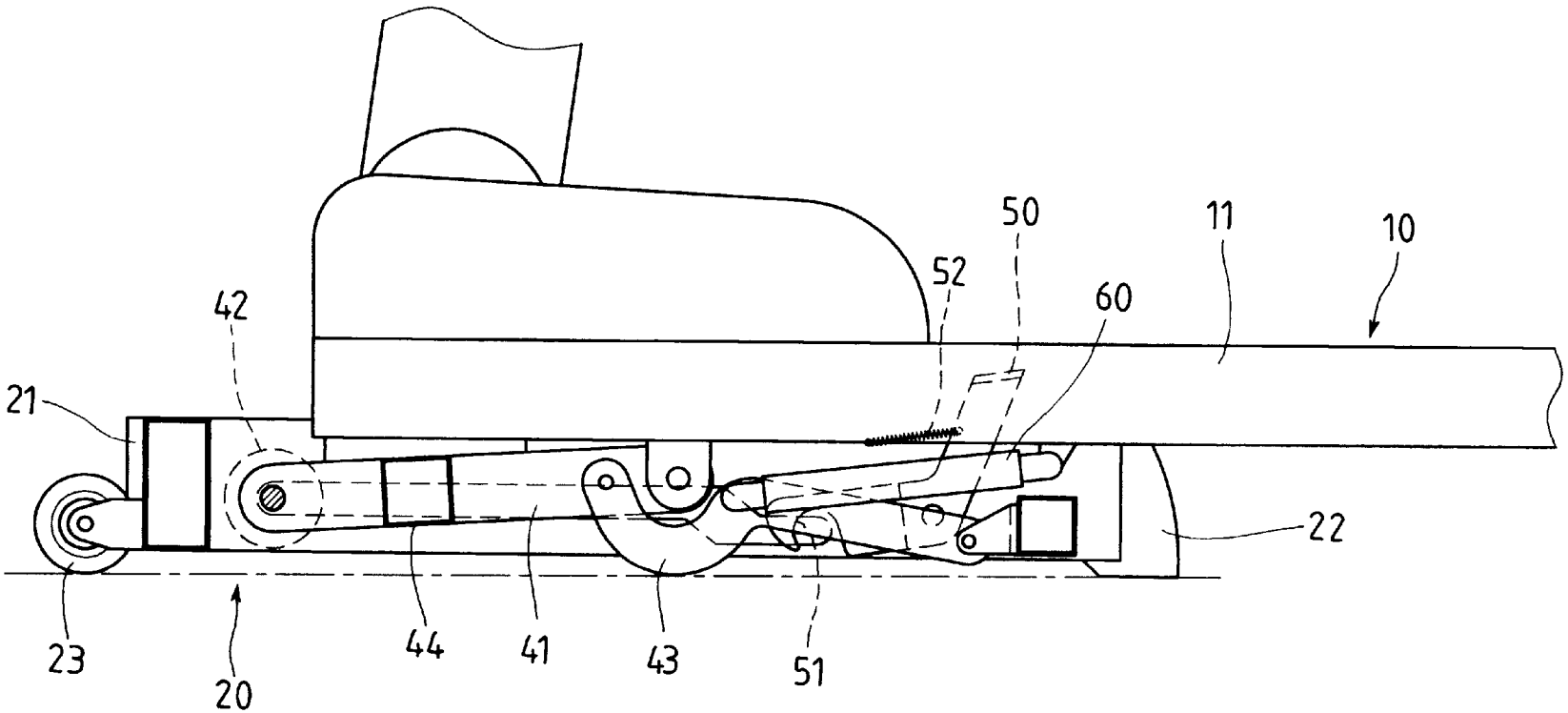
FIG. 3 shows an enlarged view of the folding device when the operation frame is located in horizontal position.
Figure 4:
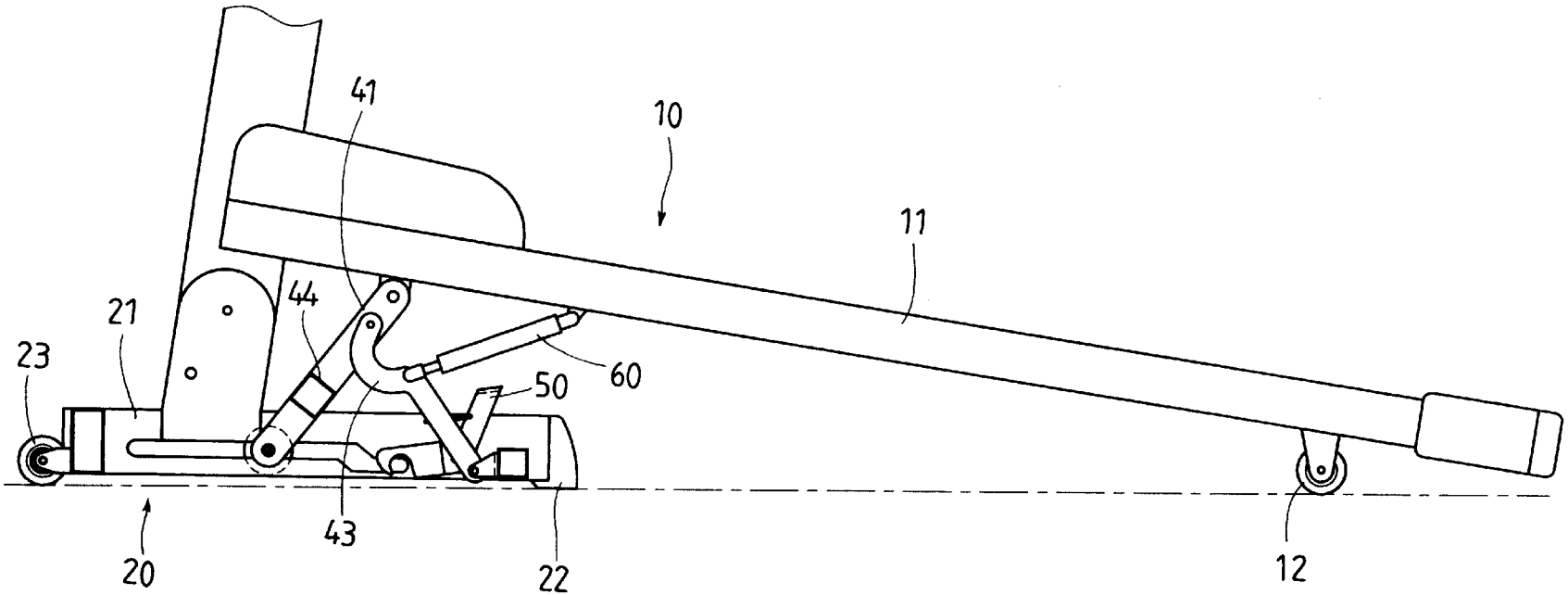
FIG. 4 shows that an end of the operation frame is lifted by the folding device.

Referring to FIGS. 1 to 3, the treadmill of the present invention comprises a rectangular base 20 that comprises two side tubes 21 and each of the side tubes 21 has a slot 212 defined in an inside thereof. An aperture 213 is defined in an underside of each of the two side tubes 21 and communicates with an interior 211 of the side tube 21. Two support rollers 23 are connected to a rear end of the base 20. Two posts 200 extend from the two side tubes and a handle and a display device (both not shown) are connected to the two posts 200.

A folding device is movably connected between the two side tubes 21 of the base 20 and comprises a shaft 40 which has two rollers 42 connected to two ends of the shaft 40. Two ends of the shaft 40 extend in the two respective slots 212 and the two rollers 42 are received in the interior 211 in the two side tubes 21. Two side frames 41 are connected to the shaft 40 and two sides 11 of an operation frame 10 pivotally connected to the two side frames 41. A belt (not shown) is rotatably connected between the two sides 11 of the operation frame 10.

Two links 43 are pivotally connected between the two side frames 41 and a front of the base 20. A cylinder 60 is pivotably connected between each of the links 43 and each of the two sides 11 of the operation frame 10 so that when the operation frame 10 is positioned at an upright position, the cylinders 60 are set to their extended positions to prevent the operation frame 10 from collapsed down. A transverse bar 44 is connected between the two side frames 41 and a worm rod 30 is rotatably connected to a support frame 441 on the transverse bar 44. The worm rod 30 is driven by a motor (not shown) so that the rollers 42 can be rotated by the motor and the worm rod 30 to assist the folding action.

When the operation frame 10 is positioned at a horizontal position, the operation frame 10 is supported by rollers 12 on an underside of the operation frame 10 and the base 10 is supported by the support rollers 23 and the pads 22 on the front end of the base 10. The rollers 42 are received in the side tubes 21. The inclination of the operation frame 10 can be adjusted by using the motor and the worm rod 30 to let the rollers 42 move in the side tubes 21.

Figure 5:
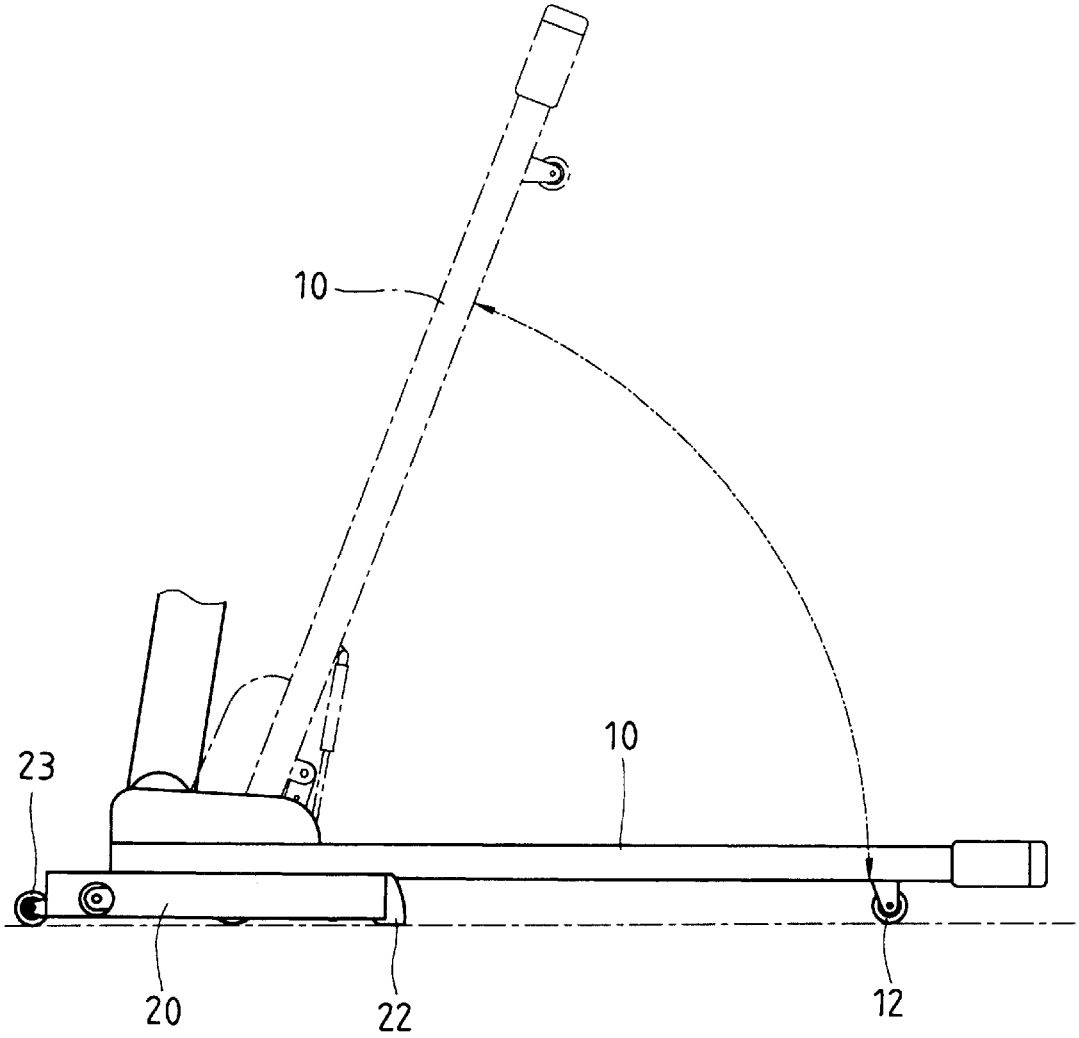
FIG. 5 shows the operation frame is folded upward.
Figure 6A:
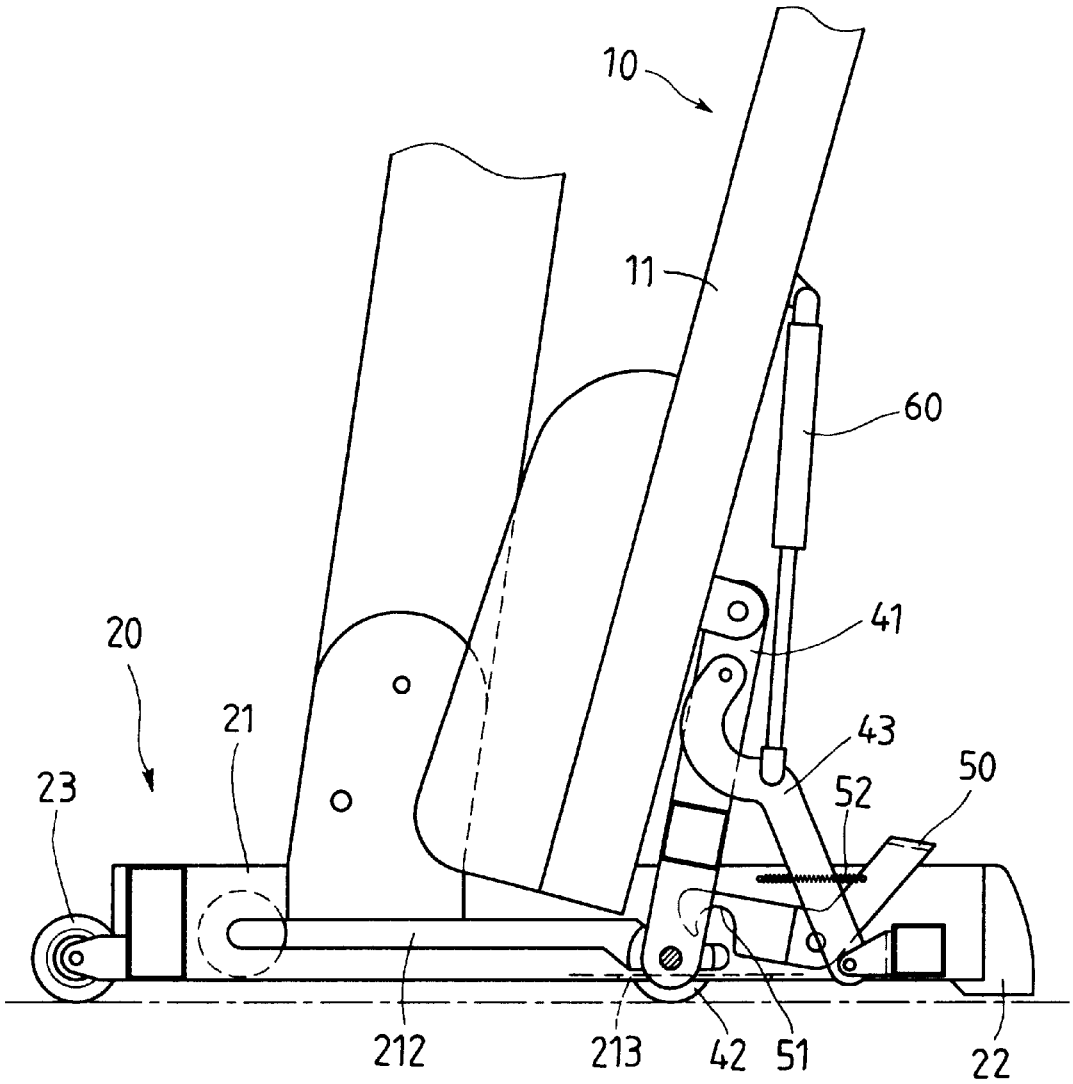
FIG. 6A shows that the operation frame is positioned at the upright position while the hook member is not yet hooked on the shaft of the folding device.
Figure 6B:
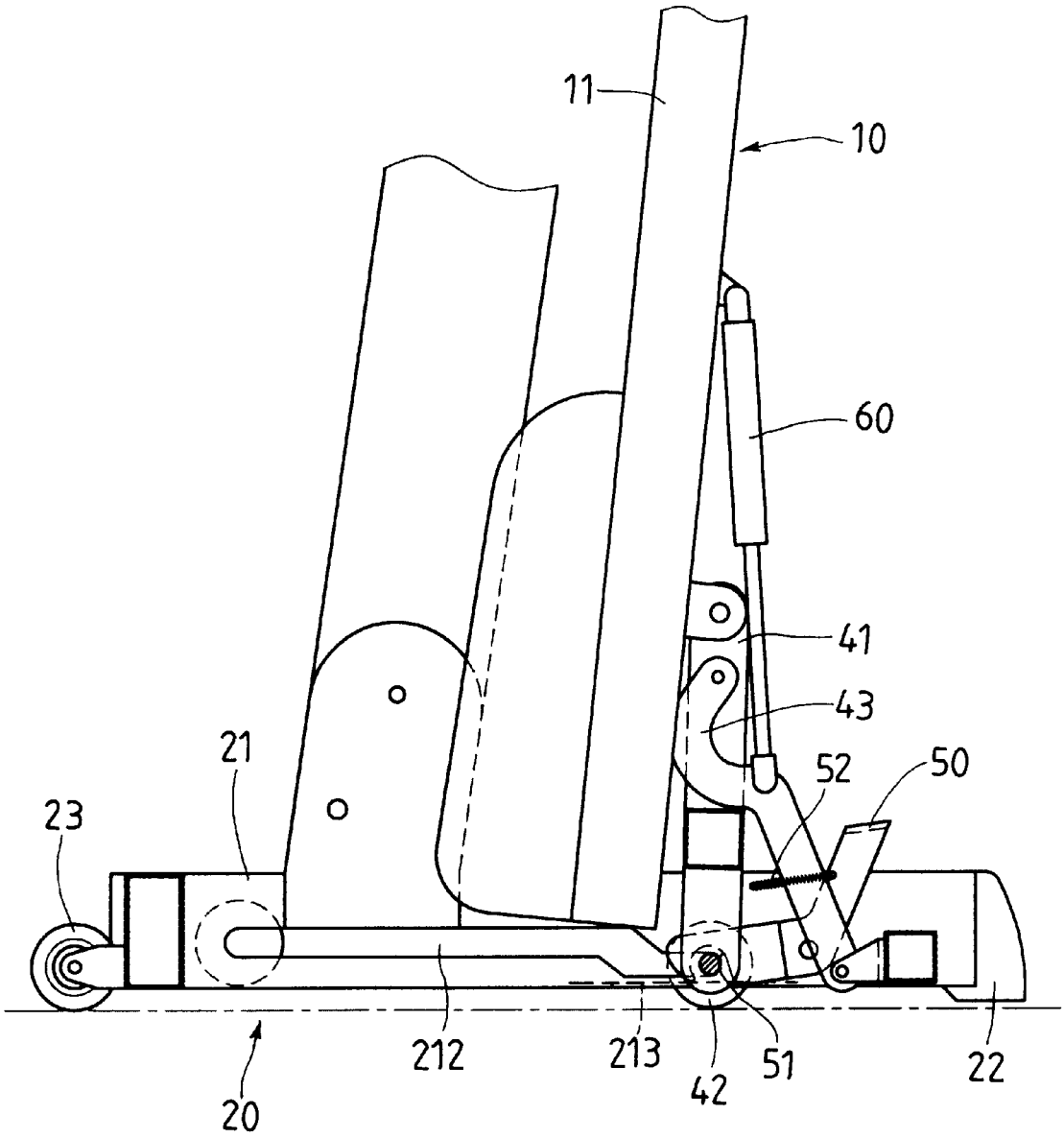
FIG. 6B shows that the operation frame is positioned at the upright position while the hook member is hooked on the shaft of the folding device.
Figure 7:
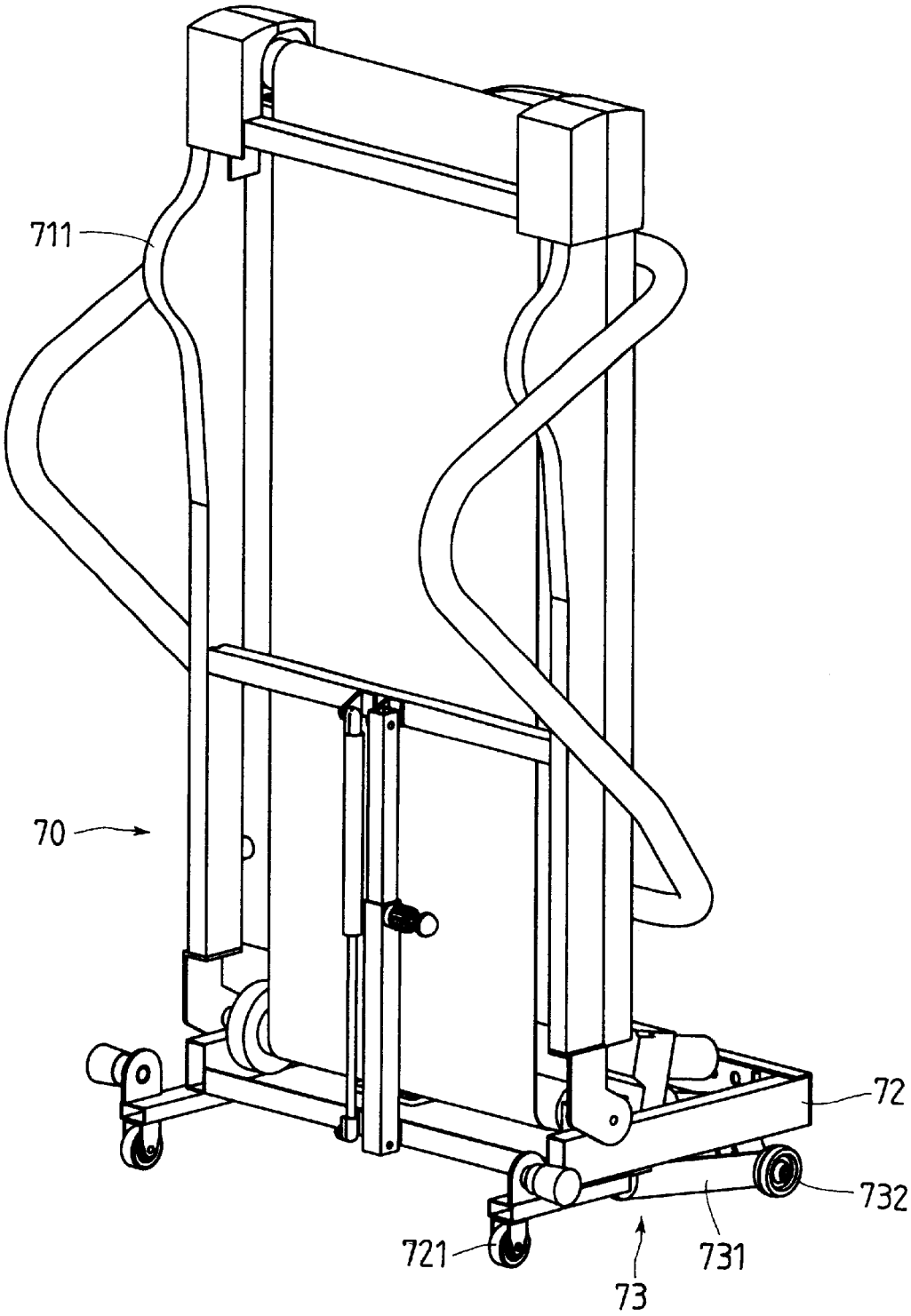
FIG. 7 is a perspective view to show a conventional treadmill wherein the operation frame is positioned at upright position.
Figure 8A:
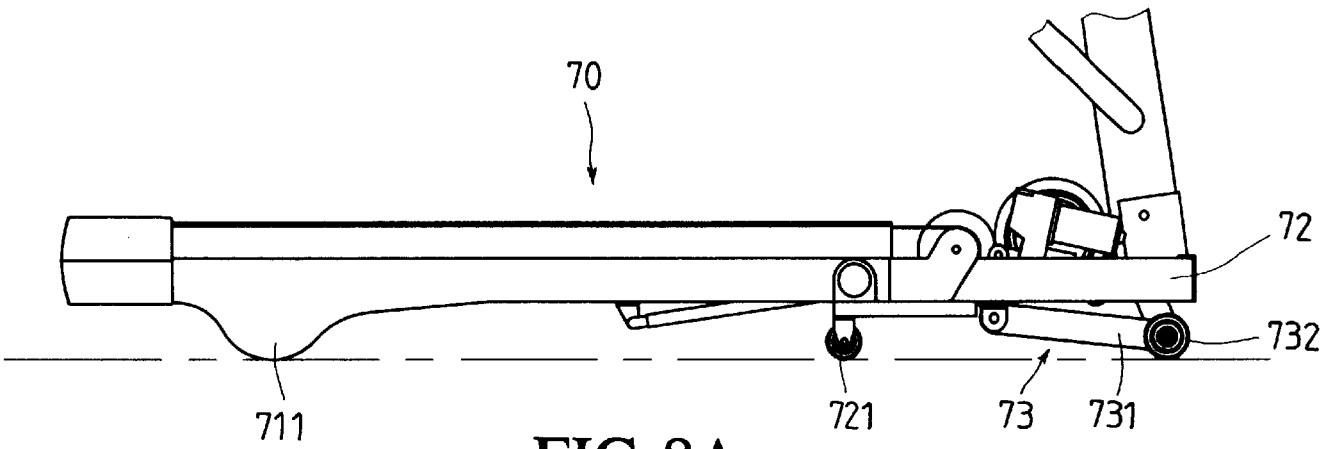
FIG.8A PRIOR ART
FIG. 8A shows the operation frame of the conventional treadmill is positioned at the horizontal position.
Figure 8B:
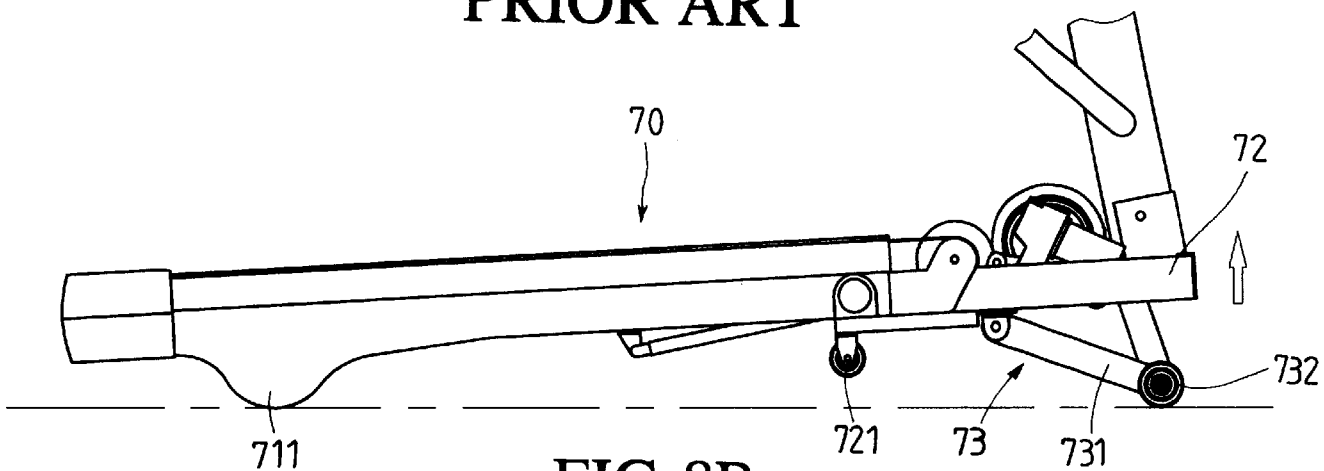
FIG.8B PRIOR ART
FIG. 8B shows an end of the operation frame of the conventional treadmill is lifted.

Referring to FIGS. 5, 6A and 6B, the operation frame 10 is folded upward by moving the rollers 42 toward the front end of the base 20. The rollers 42 drop through the apertures 213 of the side tubes 21 and contact the floor to provide a better support of the treadmill. A hook member 50 is pivotally connected to one of the two side tubes 21 of the base 20 and a spring 52 is connected between the hook member 50 and the base 20. A notch 51 is defined in the hook member 50 so as to be engaged with a section 411 as shown in FIG. 1 of the shaft 40 when the operation frame 10 is folded at an upright position. The hook member 50 holds the shaft 40 of the folding device so that the operation frame 10 at the upright position is secured. The hook member 50 is able to be disengaged from the section 411 by pushing the distal end of the hook member 50.

While we have shown and described the embodiment in accordance with the present invention, it should be clear to those skilled in the art that further embodiments may be made without departing from the scope of the present invention.

What is claimed is:

1. A treadmill comprising:

a base comprising two side tubes and each side tube having a slot defined in an inside thereof and an aperture defined in an underside of each of the two side tubes, the two apertures communicating with an interior of the two side tubes, and a folding device comprising a shaft and two rollers connected to two ends of the shaft, two ends of the shaft extending in the two respective slots and the two rollers received in the interior in the two side tubes, two side frames connected to the shaft and two sides of an operation frame pivotally connected to the two side frames, two links pivotally connected between the two side frames and the base;

wherein the two rollers drop through the apertures to contact the floor when the treadmill is folded to an upright position.

2. The treadmill as claimed in claim 1, wherein a cylinder pivotably connected between each of the links and each of the two sides of the operation frame.

3. The treadmill as claimed in claim 1 further comprising a hook member pivotally connected to one of the two side tubes of the base and a spring connected between the hook member and the base, a notch defined in the hook member so as to be engaged with the shaft when the operation frame is folded at an upright position.

* * * * *